US006187258B1

(12) United States Patent
Hamberger et al.

(10) Patent No.: US 6,187,258 B1
(45) Date of Patent: Feb. 13, 2001

(54) OPERATING METHOD AND DEVICE FOR A SHAFT FURNACE

(75) Inventors: Ralf Hamberger, Kempen; Juergen Schmidt, Herborn; Gerhard Von Hoesslin, Duesseldorf, all of (DE)

(73) Assignee: Messer Griesheim GmbH (DE)

( * ) Notice: Under 35 U.S.C. 154(b), the term of this patent shall be extended for 0 days.

(21) Appl. No.: 09/308,012

(22) PCT Filed: Oct. 25, 1997

(86) PCT No.: PCT/EP97/05906

§ 371 Date: May 11, 1999

§ 102(e) Date: May 11, 1999

(87) PCT Pub. No.: WO98/21536

PCT Pub. Date: May 22, 1998

(30) Foreign Application Priority Data

Nov. 13, 1996 (DE) ..... 196 46 802

(51) Int. Cl.[7] ..... C21B 7/16
(52) U.S. Cl. ..... 266/47; 266/268
(58) Field of Search ..... 266/47, 268; 75/460, 75/414, 459, 458, 463

(56) References Cited

U.S. PATENT DOCUMENTS 3,892,517 * 7/1975 Ebeling et al. ..... 266/47
4,921,532 * 5/1990 Corbett et al. ..... 75/460
5,522,916 * 6/1996 Karinithi et al. ..... 75/414

* cited by examiner

*Primary Examiner*—Scott Kastler
(74) *Attorney, Agent, or Firm*—Connolly Bove Lodged Hutz LLP

(57) ABSTRACT

A method for operating a blast furnace includes feeding metallic charge materials, alloy elements and energy carriers in the upper part of the furnace shaft. An oxidizing agent is fed in the lower part of the shaft. Filler material, namely, alloy elements, metal chips, carbon, sands, dust are fed individually or in combination into the melting zone in at least one burst jet. Fuels may be introduced additionally into the first jet. The oxygen is fed at a high speed into the melting zone in at least one separate jet and the conditions of introducing the materials in the first jet and the oxygen in the second jet are controlled so that no flame can be formed.

20 Claims, 3 Drawing Sheets

OPERATING METHOD AND DEVICE FOR A SHAFT FURNACE

BACKGROUND OF THE INVENTION

The invention relates to a method for operating a blast furnace, in particular a cupola furnace, to which metallic charge materials, alloy elements and energycarriers, such as coke, are fed in the upper part of the shaft, and an oxidizing agent, such as air, is fed in the lower part of the shaft, filler materials, namely alloy elements, metal chips or dusts, being supplied to the melting zone.

The introduction of such filler materials into the melting zone separately from one another is standard in the prior art.

For instance, it is known to inject alloy elements, such as carburizing compounds, silicon carbide or ferrosilicon, into the melting zone of cupola furnaces with the aim of correcting the iron analysis (EP 0 336 121 B1)

In recent times, dusts occurring in the foundry and in the operation of cupola furnaces have been injected in the tuyere zone for the furnace wind of the cupola furnace (EP 0 504 700 A1). Such dusts are, for example, filter dusts from cupola furnace dedusting, used foundry sands which can no longer be reconditioned, dusts from the cleaning department and grinding floor, etc. These dusts contain, inter alia, $SiO_2$ which can be used as slag-forming constituents for the cupola furnace melting process, as well as combustible organic constituents whose calorific value can be used for the melting process. Some of these dusts are considered to be special waste which is expensive to dispose of.

In the case of injection into the melting zone of the cupola furnace, the calorific value of the combustible constituents of the dusts is used as melting energy and the $SiO_2$ is used as a slag-forming constituent.

Problematic constituents of the dusts, such as heavy metals, are integrated into the slag, e.g. vitrified, in an environmentally friendly manner.

All these filler materials which are introduced into the melting zone of the cupola furnace have to be injected under different and, in some cases, contradictory conditions. Whereas for the alloy elements a deoxidizing atmosphere is required at the point of injection, for dusts which have a high calorific value, there must be an oxidizing operation. In the case of dusts which have a low calorific value, it is expedient to introduce an energy carrier as well, so that the slagging of the $SiO_2$ proportion of these dusts does not take place at the cost of the coke rate.

In general, the introduction, in particular of dusts, lowers the melting temperature.

To counteract this incompatibility, it was proposed in EP 0 618 419 A1 to provide a burner with supply of fuel and oxygen, and introduce the dusts into the flame of the said burner. In this case, $NO_x$ may form which is harmful to the environment. Moreover, valuable constituents of the filler materials may oxidize, i.e. burn.

SUMMMARY OF THE INVENTION

The invention is based on the object of specifying a method and an apparatus, with which the different requirements described for the use of the said filler materials can be satisfied, undesirable lowering of the melting temperature can be avoided and the occurrence of pollutants, in particular $NO_x$, to an unacceptable extent can be prevented.

When applying a method and an apparatus according to the invention, the conditions of introducing the filler materials, the fuel and the additionally introduced oxygen can be adapted in such a way, in particular the speeds can be set so high, that no flame is formed. The occurrence of $NO_x$ compounds which are harmful to the environment and the burning of valuable constituents, such as alloy elements, can thus be avoided.

The method according to the invention is equally suitable for all common types of cupola furnace, i.e. furnaces operated with hot wind, warm wind, cold wind and secondary wind, lined and unlined types of furnaces, long-duration furnaces, changing furnaces, shuttle furnaces, etc.

The charge material of such furnaces may comprise as a metallic charge:

steel scrap, returns (casting waste), scrap castings, pig iron, ferro manganese, FeSi as a non-metallic charge:

carbon (e.g. coke), silicon carbide, ferromanganese, lime, gravel, basalt.

As is known, air ("wind") is fed as oxidizing agent to the furnace via one or more rows of tuyeres, said air either being pre-heated (hot wind, warm wind) or having an ambient temperature (cold wind). Said air may be enriched with oxygen.

The method according to the invention is suitable for all sizes of furnace.

In an apparatus according to the invention, one or more of the loaded combination lances described below are installed in the melting zone of the cupola furnace to introduce the filler materials.

With an apparatus according to the invention, three different materials can be introduced into a cupola furnace simultaneously or successively in any desired order. The first material may be an alloy element, such as a carburizing compound (FeSi, SiC or the like) or dust (e.g. cupola furnace dust, used sand, cleaning dust, etc.) or iron chips or a mixture of the abovementioned materials.

The second material serves to establish the oxidizing or deoxidising conditions which are necessary for the respective use of the first material. Consequently, these materials may be gaseous, liquid and solid materials containing a calorific value, primarily materials containing carbon or hydrocarbons.

The third material compensates for the lowering of the melting temperature which occurs due to the introduction of the first two materials. It is thus oxygen which emerges from the device primarily at supersonic speed.

The three material flows can be controlled separately from one another within a range of 0%–100%. The optimum setting depends on the type, quantity and composition of material 1 and the respective requirements of the melting operation.

The conditions of introduction via the or each combination lance are adapted in such a way, in particular the speeds of introduction are selected in such a way, that the occurrence of a flame directly in front of the lance is prevented under all possible operating parameters. It is advantageous to arrange introduction through the combination lance of the oxygen in the second jet at supersonic speed, preferably within the range from 1.5 to 2.5 mach, and of the filler materials and fuels in the first jet at the speed of sound as a maximum. This ensures optimum effectiveness of the method and prevents any increase in the NO. values. In addition to the oxygen which is fed to the cupola furnace via the combination lances, oxygen may also be fed to the cupola furnace via separate oxygen lances, primarily at supersonic speed.

The combination lances according to the invention and the oxygen injection lances for the additional introduction of oxygen are preferably installed in the existing air-blast tuyeres (water-cooled copper tuyeres or uncooled, pounded tuyeres). However, it is also possible to install these devices and the additional oxygen injection lances in separate feed lines in the melting zone of the cupola furnace.

In particular, the following advantageous effects are achieved by a method and an apparatus according to the invention:

a) The supply of carburizing compounds in a deoxidizing atmosphere and additional oxygen permits lowering of the coke rate and, associated with the latter, a higher melting rate, less harm to the environment and the possibility of rapid analysis correction.

b) The supply of FeSi or SiC in a deoxidizing atmosphere and additional oxygen permits a reduction in the introduction of SiC formed bodies via the charge make up and a rapid analysis correction (cost saving as a result of less Si burn-off).

c) The supply of chips in conjunction with oxygen permits optimum return of the chips into the furnace, less or no discharge and an optimum yield. Furthermore, the iron analysis can be controlled by the introduction of casting or steel chips, and the iron temperature can be lowered, if necessary.

d) The supply of dusts in possible conjunction with additional fuel and oxygen permits the slag practice to be controlled instantaneously and problematic materials to be converted to harmless materials (in vitrified form) without having to add any more coke, and gravel as slag-forming constituent to be dispensed with.

e) The supply of oxygen, preferably at supersonic speed provides the possibility of adapting the melting rate over a broad range, reducing the melting costs (saving in coke, saving in SiC, less accumulation of dust, reduction of the cost of power, etc.) and increasing in the iron temperature. Furthermore the air-blast tuyeres are subjected to less thermal loading.

BRIEF DESCRIPTION THE DRAWINGS

The invention is explained in greater detail below by way of exemplary embodiments with further details with reference to diagrammatic drawings, in which.

DETAILED DESCRIPTION

Figure 1:
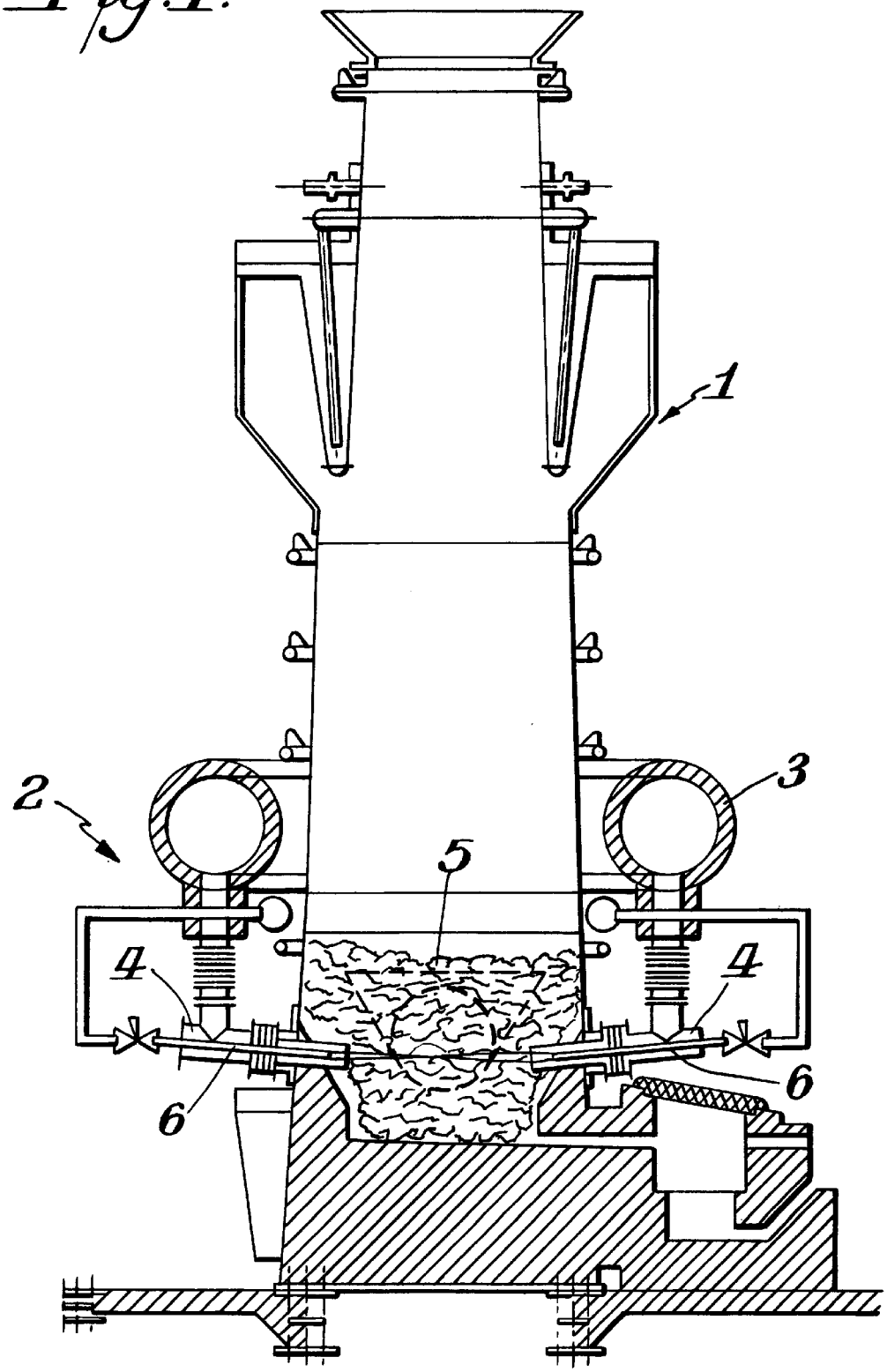
FIG. 1 shows a vertical section through a cupola furnace which is equipped with apparatuses according to the invention.

FIG. 1 shows a cupola furnace which is known in principle and has a shaft in whose upper part 1 metallic charge materials, alloy elements and energy carriers, such as coke, are introduced, and in whose bottom part 2 an oxidizing agent, such as air, —the so-called furnace wind—is introduced via a wind belt 3 and from there via introduction channels 4 into the melting zone 5. Combination lances, denoted in total by the reference numeral 6, according to the invention are inserted into a least two diagonally opposite introduction channels 4.

Figure 2:
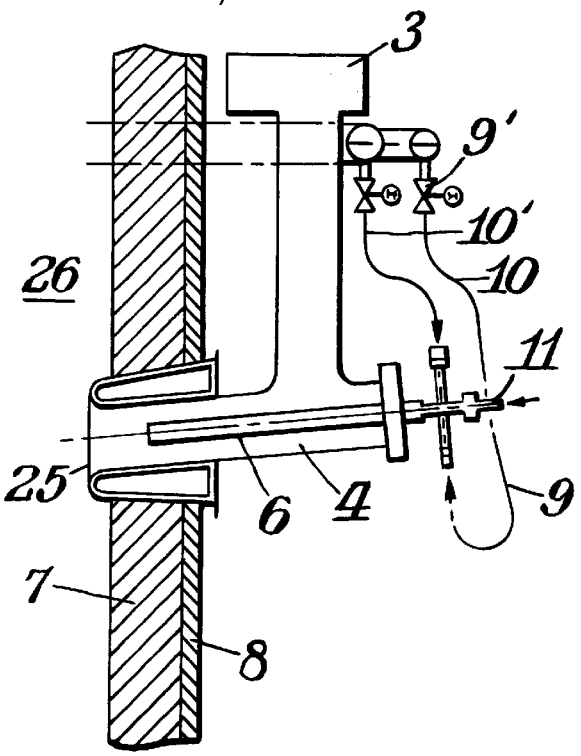
FIG. 2 shows an enlarged partial section through the furnace wall at the height of the melting zone through an introduction channel for the wind into which an apparatus according to the invention is inserted.

A location on the furnace wall which consists of the lining 7 and the furnace shell 8 and is penetrated by an introduction channel 4 for the furnace wind with a combination lance 6 inserted is shown with greater clarity in the partial section according to FIG. 2. The combination lance 6 is provided with lines 9 for oxygen and 10 for fuel, such as combustible gases, and with a central feed line 11 for filler materials, such as dusts, used casting sands, alloy elements, metal chips, carbon and the like. The reference numerals 9' and 10' denote individually actuable shut-off valves for the lines 9 and 10.

Figure 5:
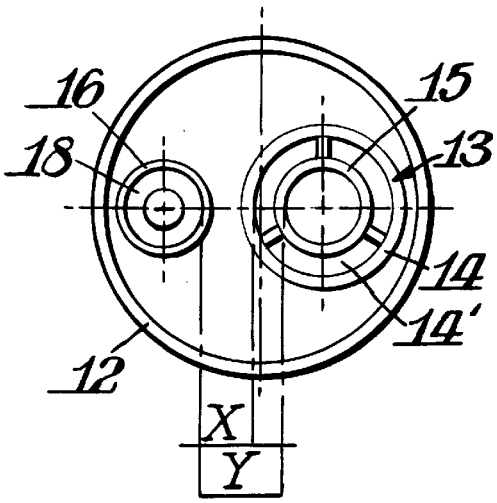
FIG. 5 shows an enlarged section, like FIG. 4, in a modified configuration.
Figure 3:
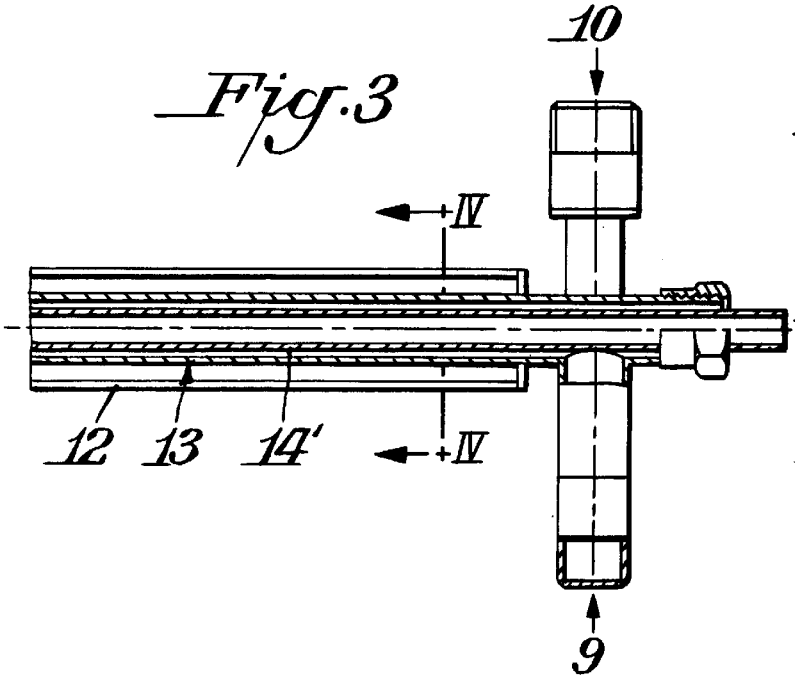
FIG. 3 shows a longitudinal section along the line III—III in FIG. 4 through an apparatus according to FIG. 2.
Figure 4:
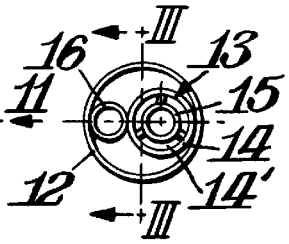
FIG. 4 shows a section along the line IV—IV in FIG. 3.

The structure of the combination lance 6 can be seen in detail in FIGS. 3 to 5.

According to FIGS. 3 to 5, a sleeve 12 surrounds two lances arranged in parallel, namely a material lance 13 and an oxygen lance 16. The material lance 13 comprises an outer pipe 14 for feeding fuel, such as combustible gases (methane, natural gas or the like), via the line 9 and an inner pipe 15, which is separated from said outer pipe by means of an annular gap 14' for conveying the fuel, for feeding filler materials, such as dusts, via the line 11. The oxygen lance 16 runs parallel to the material lance 13, specifically preferably at a distance X from the outer pipe 14 and a distance Y from the inner pipe 15 as is illustrated in FIG. 5. The distance X preferably lies within a range between equal to the inside diameter of the oxygen lance 16 and ten times said inside diameter, whereas the distance Y preferably lies within a range between twice and twenty times the inside diameter of the oxygen lance 16.

In the illustration according to FIG. 3, the oxygen lance 16 is covered by the material lance 13. The feed line 10 leads into said oxygen lance 16. In its orifice, the oxygen lance 16 has a Laval nozzle 18, as is indicated in FIG. 5 and is shown in axial section in FIG. 6 for a separate oxygen injection lance 20. By means of said Laval nozzle, the oxygen is injected into the melting zone 5 at supersonic speed via the oxygen lance 16, as also via the oxygen injection lance 20 according to FIG. 6. In contrast, oxygen fed additionally in the material lance 13 via the annular gap 14' and the combustible gas fed here too are injected only at the speed of sound as a maximum. Oxygen may also be mixed in with the dust or other filler materials fed via the inner pipe 15. Here too, the speed of sound is not exceeded during the injection.

Figure 6:
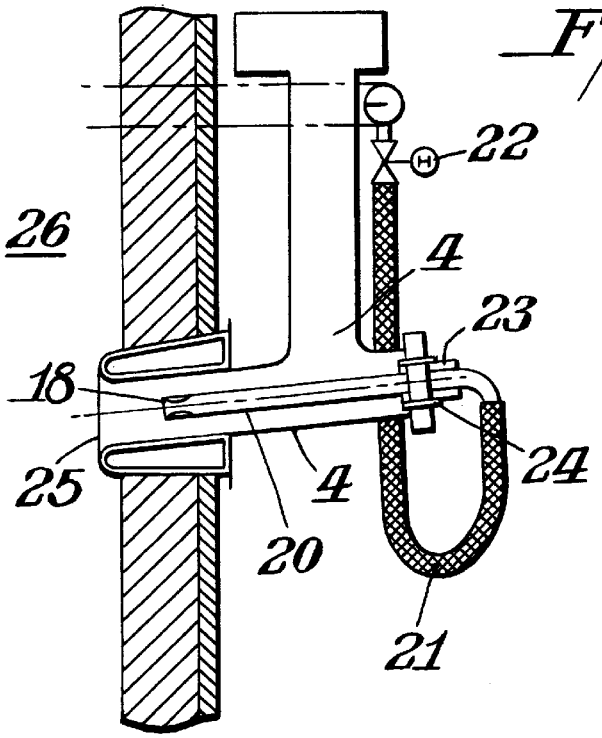
FIG. 6 shows a partial section similar to FIG. 2 at the height of the melting zone through an introduction channel for the wind, into which an oxygen injection lance is inserted.

In the same illustration as FIG. 2, FIG. 6 shows an oxygen injection lance 20, inserted into a different introduction channel 4 for furnace wind, with a Laval nozzle 18 inserted into the orifice. Here, selectively, only oxygen can thus be injected at supersonic speed. In FIG. 6, 21 denotes an oxygen line, 22 a shut-off valve, 23 a quick-action coupling and 24 a lance holder for the oxygen injection lance 20. The devices 23 and 24 can, of course, also be provided on the combination lance 6.

The operator can thus decide for short periods, for example daily, depending on the batch to be inserted, the operating conditions, the results of analyses of the furnace contents and the fuels and filler materials ready to be injected, whether and to what extent and where he will additionally inject oxygen and filler materials.

In all cases of injection, whether it is via the combination lances (usually at least two) or additionally via separate oxygen injection lances 20, the conditions of introduction, in particular the injection speeds, are so high that no flame is formed in the immediate vicinity in front of the orifice 25 into the interior 26 of the furnace. Combustion of valuable constituents, such as alloy elements and the like, is thus avoided and, moreover, formation of environmentally harmful $NO_x$ compounds to an unacceptable extent is avoided.

Figure 7:
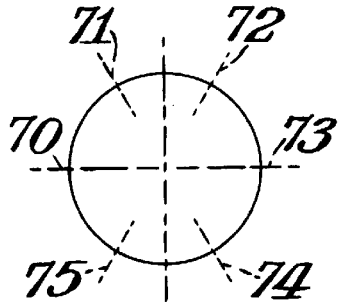
FIGS. 7, 8 and 9 show cross sections through the melting zone of the cupola furnace with an arrangement of combination lances according to FIGS. 2 to 5 and oxygen injection lances according to FIG. 6 in three variants.
Figure 8:
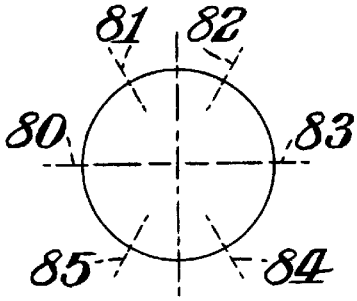
Figure 9:
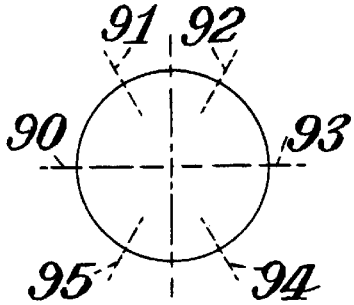

FIGS. 7 to 9 show cross sections through a cupola furnace at the level of the introduction channels for the wind diagrammatically with three (of many possible other) variants of introduction of oxygen and the filler materials mentioned and of fuels according to the invention.

In the refinement according to FIG. 7, combination lances 6 according to FIGS. 2 to 5 are inserted, located diagonally opposite one another at the locations 70, 73, into the introduction channels 4, whereas oxygen injection lances 20 according to FIG. 6 are inserted at the locations 71, 72; 74, 75.

In the embodiment according to FIG. 8, a total of three combination lances 6 according to FIGS. 2 to 5 are inserted in each case offset by 120°, whereas oxygen injection lances 20 according to FIG. 6 are arranged at the three locations 81, 83 and 85 in each case offset by 60° relative to said combination lances.

Finally, in the variant according to FIG. 9, combination lances 6 are inserted again located diagonally opposite one another at the locations 90, 93. Oxygen injection lances are arranged located diagonally opposite one another at the locations 91, 94, whereas the introduction channels for the furnace wind are left vacant at the locations 92, 95 likewise located diagonally opposite one another.

It is evident that numerous further variants are conceivable. For instance, apart from two combination lances located diagonally opposite one another, all the further wind introduction channels 4 could be left vacant.

The large number of variants becomes even greater, of course, if more than six wind introduction channels 4 are provided in the furnace wall around the melting zone.

It is evident that, with the method and the apparatus according to the invention, the operator receives a very great amount of freedom when operating the cupola furnace which permits him to adapt quickly to changing analysis results, operating conditions, batches, introduction of different filler materials and fuels, so that a quality approaching the achievable optimum of the melt can always be achieved with the minimum of harm to the environment at the same time. The introduction of dusts and used sands permits eluate-safe disposal.

What is claimed is:

1. A method for operating a blast furnace comprising shaft having an upper part and a lower part and a melting zone, to which metallic charge materials, alloy elements and energy carriers are fed in the upper part of the shaft, and an oxidizing agent is fed in the lower part of the shaft, filler materials, namely alloy elements, metal chips, carbon, sands, and dusts being fed into the melting zone in at least one first jet, wherein oxygen is fed at a high speed directly into the melting zone in at least one separate second jet, and wherein the conditions of introducing the materials mentioned in the first jet and the oxygen in the second jet are controlled in such a way that no flame can be formed.

2. The method as claimed in claim 1, wherein the oxygen in the second jet is fed at supersonic speed.

3. The method as claimed in claim 1 or 2, wherein combustible gas and/or oxygen in the first jet is fed at the speed of sound as a maximum.

4. The method as claimed in claim 1, wherein the alloy elements are introduced in a deoxidizing atmosphere, dusts with a high calorific value are introduced with the supply of oxygen and dusts with a low calorific value are introduced with the supply of fuels and oxygen.

5. An apparatus for operating a blast furnace having a shaft and a lower part and a melting zone, characterized in that at least one combination lance combined, in a constructional unit, to include a material lance directed to the melting zone for forming a first jet and an oxygen lance directed to the melting zone for forming a second jet, and said oxygen lance being capable of feeding oxygen at a high speed directly into the melting zone.

6. The apparatus as claimed in claim 5, wherein the oxygen lance is fitted with a Laval nozzle.

7. The apparatus as claimed in claim 5 or 6, wherein the material lance has an inner pipe for conveying filler materials and an outer pipe, which surrounds the inner pipe with an annular gap, for conveying fuels through the annular gap.

8. The apparatus as claimed in claim 5, wherein the material lance and the oxygen lance are arranged adjacently in a sleeve.

9. The apparatus as claimed in claim 5, wherein a separate lance is provided for each of the filler materials.

10. The apparatus as claimed in claim 5, wherein oxygen injection lances, arranged separately from the combination lance, are provided for introducing additional oxygen.

11. The apparatus as claimed in claim 5, wherein the at least one combination lance is installed in existing introduction channels for furnace wind.

12. The apparatus as claimed in 11, wherein the at least one combination lance is accommodated in separate introduction channels in the furnace walls, which channels open into the melting zone.

13. The apparatus as claimed in claim 11, wherein at least one oxygen injection lance is inserted into an introduction channel, not occupied by a combination lance, for furnace wind.

14. The apparatus as claimed in claim 5, wherein at least one oxygen injection lance is inserted into a separate opening which is not occupied by a combination lance.

15. The method as claimed in claim 1 wherein fuels are introduced additionally into the first jet.

16. The method as claimed in claim 15 wherein the fuels are introduced together with oxygen into the first jet.

17. The method as claimed in claim 1, wherein the filler materials are fed individually into the melting zone.

18. The method as claimed in claim 1, wherein the filler materials are fed in combination into the melting zone.

19. The method as claimed in claim 2, wherein the speed is within the range of 1.5 to 2.5 mach.

20. The apparatus as claimed in claim 5, wherein the oxygen lance includes a Laval nozzle for feeding oxygen at a supersonic speed.

* * * * *